US008266875B2

(12) United States Patent
Caudwell

(10) Patent No.: US 8,266,875 B2
(45) Date of Patent: Sep. 18, 2012

(54) METHOD AND MEANS OF REDUCING LOSS OF HEAT OF EVAPORATION

(76) Inventor: Christopher Hugh Caudwell, Wellington (NZ)

( * ) Notice: Subject to any disclaimer, the term of this patent is extended or adjusted under 35 U.S.C. 154(b) by 0 days.

(21) Appl. No.: 12/672,896

(22) PCT Filed: Sep. 2, 2008

(86) PCT No.: PCT/NZ2008/000224

§ 371 (c)(1),
(2), (4) Date: Feb. 10, 2010

(87) PCT Pub. No.: WO2009/031907

PCT Pub. Date: Mar. 12, 2009

(65) Prior Publication Data

US 2011/0179751 A1 Jul. 28, 2011

(30) Foreign Application Priority Data

Sep. 3, 2007 (NZ) ..... 561107
Jan. 8, 2008 (NZ) ..... 564928

(51) Int. Cl.
*B65B 53/04* (2006.01)

(52) U.S. Cl. ..... 53/442; 53/557

(58) Field of Classification Search ..... 53/442, 53/557; 34/219, 224; 219/401; *B65B 53/04*
See application file for complete search history.

(56) References Cited

U.S. PATENT DOCUMENTS

| | | | | | |
|---|---|---|---|---|---|
| 2,119,261 | A * | 5/1938 | Andrews | 34/224 |
| 2,906,627 | A * | 9/1959 | Payton et al. | 53/442 |
| 3,389,478 | A * | 6/1968 | Cline | 53/557 |
| 3,678,244 | A * | 7/1972 | Worline | 53/557 |
| 3,897,671 | A * | 8/1975 | Higgins | 53/442 |
| 4,538,363 | A * | 9/1985 | Zagoroff | 53/442 |
| 4,616,123 | A * | 10/1986 | Zagoroff | 219/388 |
| 4,738,082 | A * | 4/1988 | Saitoh | 53/557 |
| 4,987,688 | A * | 1/1991 | Petit et al. | 34/219 |
| 5,105,558 | A * | 4/1992 | Curry | 34/219 |
| 5,400,570 | A * | 3/1995 | Bennett | 53/442 |
| 5,899,048 | A * | 5/1999 | Havens et al. | 53/442 |
| 5,942,142 | A * | 8/1999 | Forney et al. | 219/401 |
| 2006/0243721 | A1 * | 11/2006 | Sorensen et al. | 219/401 |
| 2009/0071107 | A1 * | 3/2009 | Ehrmann | 53/442 |

FOREIGN PATENT DOCUMENTS

| | | | |
|---|---|---|---|
| DE | 3924871 | A1 * | 2/1991 |
| GB | 2005524 | A * | 4/1979 |
| JP | 2001171620 | A * | 6/2001 |
| WO | WO 2006111148 | A1 * | 10/2006 |

* cited by examiner

*Primary Examiner* — Stephen F Gerrity
(74) *Attorney, Agent, or Firm* — Young & Thompson

(57) ABSTRACT

A hot water shrink tunnel includes a heat chamber that has no flue or vent into the heat chamber, an inlet opening and spaced therefrom an outlet opening. Each opening is closed by an end closing device, such as a curtain. A conveyor carries a product through the heat chamber from the inlet opening to the outlet opening. A duct is mounted adjacent each end opening, where the duct includes a shroud of a size and design to capture hot water vapor that issues from the heat chamber when a product passes through the end closing device of the non-flued/un-vented tunnel.

20 Claims, 4 Drawing Sheets

METHOD AND MEANS OF REDUCING LOSS OF HEAT OF EVAPORATION

BACKGROUND OF THE INVENTION

This invention relates to a method and means of reducing the loss of heat of evaporation of liquid, typically water.

There are industrial applications where the objective is not to evaporate water but which require a tank of water exposed to atmosphere at an elevated temperature below boiling point. Such processes include heat shrinking of plastic packaging films, cooking, washing, tanning, and dyeing. In these processes it is not possible to use a sealed lid because openings allowing continual physical access to the heated fluid are required. In these applications heat loss due to unwanted evaporation is a large component of the total operating cost.

This is a particularly difficult problem in the heat shrinking of flexible plastic vacuum packages in so called shrink tunnels.

Throughout this description the term "shrink tunnel" is used for convenience. Most of the technology described also applies to other, forms of hot water shrink equipment including immersion tunnels and dip tanks.

Evaporation of water occurs in existing hot water packaging film shrink tunnels but serves no useful part of the packaging function. It is thus an unavoidable overhead cost. It tends to discourage vacuum shrink packaging in competition with non shrinkable packaging media. New technology which reduces the cost of the shrink process would thus be of great interest to packaging suppliers with an interest in supplying shrink packaging materials.

A shrink tunnel is also a special case of the much wider problem relating to the difficulty of cost effective recovery of so called low grade (i.e. low temperature) heat. Low temperature in this sense means below boiling.

Shrink packaging tunnels usually operate in air conditioned food handling areas where heat and high humidity in the working environment needs to be avoided in order to restrict growth of undesirable contaminating micro-organisms. For this reason it is necessary to minimise the escape of hot wet air from the tunnel openings at either end. These openings are fitted with flexible curtains to minimise escape of hot water vapour but to date the only method available to minimise hot vapour loss through the curtains has been to fit a vertical flue in the top of the tunnel to provide an updraft. By reducing the internal humidity level and in particular the atmospheric pressure inside the tunnel the flue minimises the escape of water vapour into the packing room through the end curtains as they open to admit or eject packages. However, by reducing the water vapour pressure inside the tunnel the flue also maximises the evaporation rate and hence the energy wastage.

Known hot water shrink tunnels can be of a spray or immersion type. The present invention is effective with both types. Water sprays increase the water surface area, encourage evaporation and therefore maximise heat loss. The heat tunnel spray is, however, required to thoroughly heat the plastic film passing through but the evaporation of water within the spray is an undesirable side effect of the operation of the tunnel due to the large water surface area promoting high evaporation.

This high rate of evaporation can also occur when a body of liquid (water) is agitated by stirring. Thus in an immersion type shrink tunnel the passage of a conveyor and product items through the water reservoir causes the water surface to be agitated so that a fresh water surface is continually being exposed thereby leading to increased evaporation.

In a standard tunnel the unwanted evaporated water vapour pressure is reduced by allowing hot water vapour (water vapour gas being lighter than air) to rise up the flue in order to minimise the flow of hot wet air out through the tunnel exit and entrance openings. Most of the heat loss is thus via the flue connected to top of the shrink tunnel. It is known that as much as 70% to over 90% of the energy produced in a standard shrink tunnel is lost up the flue. The high energy loss is thus latent heat of evaporation disappearing up the flue in the form of excess water vapour.

SUMMARY OF THE INVENTION

It is an object of the invention to provide a method of operating a shrink tunnel which reduces energy losses by reducing evaporation.

In a first broad aspect of the invention there is provided a method of operating a hot water shrink tunnel the method comprising the, steps of maintaining a non flued or non vented head space within the heat chamber of the tunnel and externally of the heat chamber capturing and drawing away hot water vapour immediately it issues through an opening from the heat chamber upon product passing through sealing means associated with the opening.

Preferably there is also provided the step of separating water content from the captured hot water vapour and returning this to the heat chamber or to the hot water supply to the heat chamber.

A further object of the invention is to provide a duct for a shrink tunnel which when mounted to a shrink tunnel, and during operation of the shrink tunnel, will result in a reduction of energy losses.

Thus broadly in a second aspect of the invention there is provided a duct for a shrink tunnel, the shrink tunnel including a heat chamber which has an inlet opening, and outlet opening spaced from the inlet opening, and a end closing device at each opening to substantially provide separation of the heat chamber from ambient atmosphere yet permit product to pass through the opening, the duct including a shroud adapted to be mounted adjacent a said opening externally of the heat chamber, the shroud being of a design and size to, in use, capture hot water vapour and hot air issuing from the heat chamber when product passes through the end closing device.

In the preferred form of the invention suction means is coupled to the duct.

In the preferred form the suction means is coupled to a conduit which opens into the shroud.

A further object of the invention is to provide a shrink tunnel which is of a construction which during operation results in a reduction of energy losses.

To this end the invention in a further broad aspect comprises a hot water shrink tunnel which includes a heat chamber with an inlet opening and spaced therefrom an outlet opening, each opening is closed by an end closing device, and means for conveying product through the heat chamber from inlet opening to outlet opening, a duct mounted adjacent each end opening, the duct including a shroud of a size and design to capture hot water vapour and hot air which, in use of the shrink tunnel, issues from the heat chamber when product passes through the opened end closing device.

In the preferred form of the invention the heat chamber is a non flued or non vented.

According to the present invention the need for a flue from the heat chamber is eliminated. Also the ejection of hot water vapour and hot air through the end closing devices into the surrounding working environment is substantially eliminated.

The lack of a flue from the heat chamber enables greater water vapour partial pressure and total atmospheric pressure to rise inside the tunnel thus greatly reducing the rate of evaporation. Water evaporation largely ceases because the water vapour partial pressure inside the tunnel is maintained close to the equilibrium vapour pressure.

In a preferred form of the shrink tunnel the end closing device is a curtain.

The rate of water vapour loss out through the curtains is very much less than water vapour loss up the flue because of the lower water vapour pressure at the lower level of the curtains and also because the water vapour must escape horizontally not vertically.

In a preferred form of the invention the shroud of the duct is of a construction which is slightly longer than the maximum outward horizontal distance travelled by an upward hot wet gas flow from the opening so as to capture substantially the entire flow.

In this way troublesome ejection of moisture and heat into the working environment is substantially eliminated.

Two benefits are achieved. Firstly the tunnel flue can be removed with consequential energy saving and convenience of installation. Secondly even a shrunk tunnel which is fitted with a flue will permit the escape of some hot water vapour through the opened end curtains into the working environment but with end ducts fitted as described escape of water vapour into the room is substantially eliminated.

The heat loss through the curtains can be further designed to minimise heat loss when unopened by ensuring that the vertical lengths of flexible material which form the curtain lie closely side by side in the undisturbed state to eliminate openings.

The pressure of the water vapour and air mix inside the tunnel rises with height as stated earlier. Openings higher up the curtains result in greater heat loss than opening lower down. Slits in synthetic rubber curtains commonly terminate in a circular hole at the top of the slit to minimise tear propagation but these openings high up the curtain allow continual heat loss and must be avoided. End curtains made from hole free, slit lengths of hinged semi rigid plastic conveyor belt material are particularly suited to this application.

Preferably there is also provided means to separate and recover the water content of the hot water vapour.

In the preferred form of the invention the heat chamber is neither flued nor vented to atmosphere.

BRIEF DESCRIPTION OF THE DRAWINGS

In the following more detailed description of the invention reference will be made to a shrink tunnel which is constructed and operable in accordance with the invention. A shrink tunnel incorporating the invention is shown in schematic form in the drawings in which.

DETAILED DESCRIPTION OF EMBODIMENTS OF THE INVENTION

Figure 1:
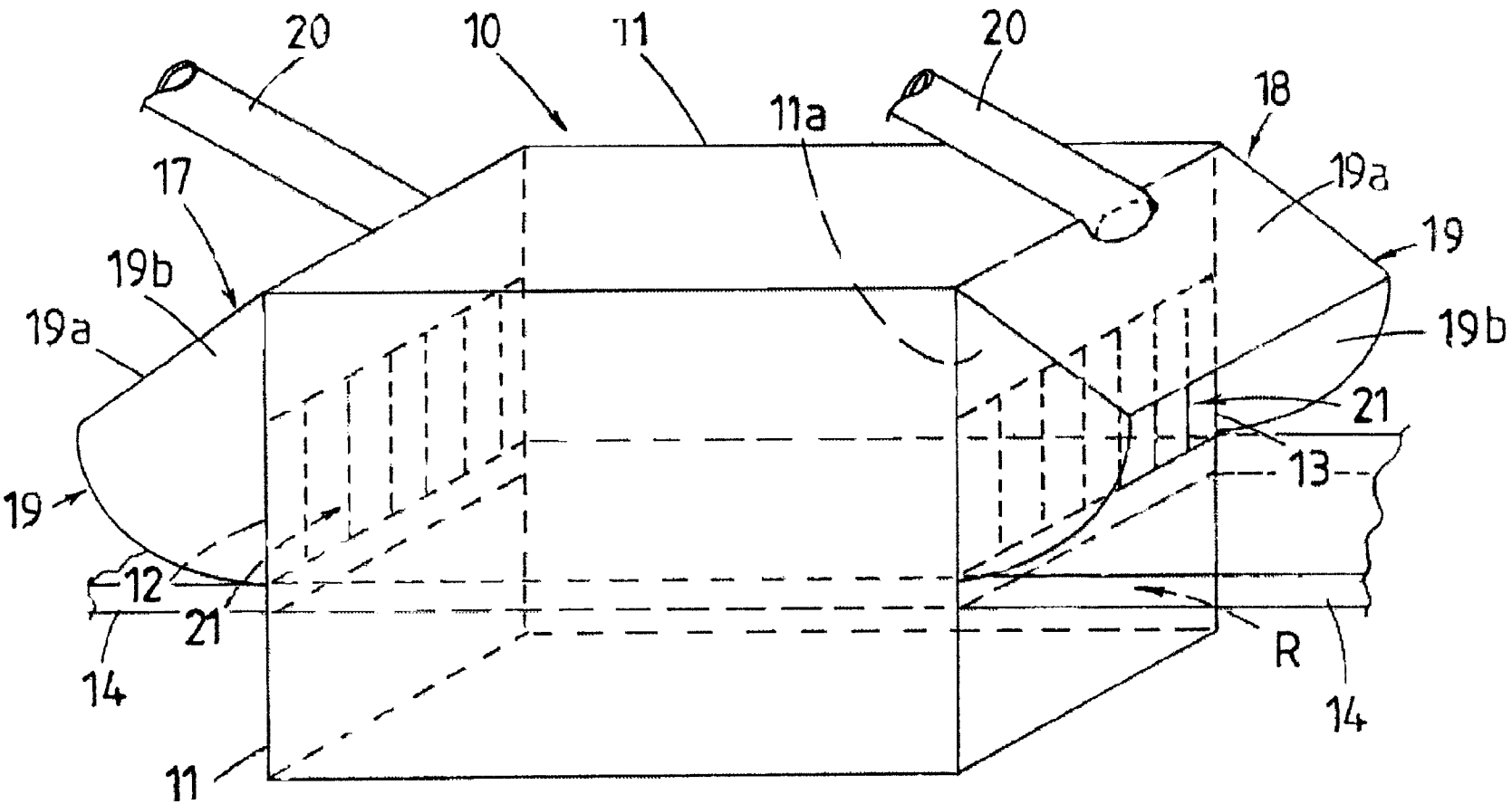
FIG. 1 is a schematic isometric illustration of a first embodiment.

The present invention is based on the discovery that, by containing water vapour in the physical environment in which the evaporation is taking place, the rate of water evaporation can be reduced and hence energy wastage reduced. Thus, according to the invention, humidity in the internal environment of the tunnel is increased. Water evaporation will accordingly slow when relative humidity approaches 100%. It will cease altogether when humidity reaches 100%.

The present invention has particular application to a shrink tunnel where in certain situations (e.g. when product flow through the tunnel ceases and good closing devices, usually curtains, are used at the entry and exit openings of the heat chamber) water evaporation will cease. Accordingly the thermostatically controlled elements in the water reservoir will be required to supply no more heat that is being lost by conduction through the outer surfaces of the tunnel.

Thus, in a shrink tunnel according to the present invention when operating with products passing through, energy wastage is reduced to only the water vapour which escapes through the entrance and exit openings when the passing objects cause gaps in the curtains.

The mix of hot water vapour and hot air inside a shrink tunnel is much lighter than air and rises quickly when released into a vertical flue in a conventional shrink tunnel. In a majority on tunnel installations this upwards flow is assisted by using a fan in order to reduce the internal pressure of the tunnel and therefore reduce the emission of hot wet air through the tunnel end openings. This reduction in internal pressure has the effect of maximising evaporative heat loss.

According to the present invention, however, the mix of water vapour and hot air is captured when it is released through the entrance/exit opening of the heat chamber. This is achieved by positioning an external duct adjacent each of the entrance and exit openings to contain the mix as it rapidly rises upon escaping through the entrance/exit opening. The mix can then be fed away to waste or preferably the water vapour is condensed and the recovered water is passed back to the reservoir of the shrink tunnel.

The present invention is thus based on the principle that when the partial pressure of water vapour in the environment (in the tunnel in the case of a shrink tunnel) approaches equilibrium, water evaporation slows to a halt. This does not require the total internal gas pressure to exceed atmospheric pressure because the equilibrium pressure for flat water at 85° C. is in the order of only 600 millibar.

Due to Archimedes principle, the gas pressure inside the tunnel headspace (i.e. the area above the top of any end opening forming the entrance and exit) increases with the height of the heat chamber above the end openings. The lower pressure at the end openings reduces the flow rate out the end openings compared with that which exits with a conventional top mounted flue.

With the above technical appreciation in mind, reference is made to the accompanying drawings which in schematic form, show a shrink tunnel 10. The tunnel 10 is of largely conventional construction. It therefore includes a housing 11 which has at one end an entrance opening 12 and at the other end an exit opening 13. A conveyor 14 or similar means of moving product P is provided for moving product through the entrance opening 12 along the tunnel (i e through the heat chamber in the housing) and out the exit opening 13.

Also in accordance with conventional shrink tunnel construction, a reservoir R for water is provided in the bottom of the housing 11. The reservoir R will generally be an insulated water tank fitted with heating elements and a thermostat. This heating system will be retained for a tunnel incorporating the present invention in order to bring it up to and maintain it at working temperature.

The thermostatically controlled heating elements switch on and off as required to maintain the water temperature in the desired range for example 84° to 85°. The energy saving provided by the new invention manifests itself, both in the reduced length of time for which the heating elements switch on, and the lengthened period of time for which they remain switched off.

Within the housing 11 will be a spray arrangement (not shown) if the tunnel is of a pumped water spray or curtain type. The tunnel can also be of an immersion type and would thus have two flexible belts to carry product under the water. A control unit (not shown) will also be included. This is in accordance with known construction and further discussion thereon is not required for the purposes of describing the present invention.

The shrink tunnel, according to the present invention, differs from a conventional construction because it does away with a vertical flue opening into the head space 16. By direct contrast it has wet air collection ducts 17 and 18 which are mounted externally at each end of the tunnel adjacent the respective entrance/exit openings 12 and 13 (hereinafter "end opening(s)"). These ducts 17 and 18 are in the form of shrouds 19 which are fitted over the top of the end openings 12 and 13 and extend down the sides of the end openings. The top 19*a* of the shroud preferably does not extend down lower than the top edge of the end opening 12/13

In accordance with known construction each end opening 12/13 is covered by a closing device which conventionally is a curtain 21. The curtain 21 will generally comprise a plurality of hanging strips. The strips will be closely adjacent one another so as to as far as possible seal closed the opening yet be able to move such as to allow the passage there through of product. It is known that hinged segments of solid plastic similar to those used in plastic conveyor belts are effective.

The shrouds 19 thus each form a collection area or space into which hot air and hot water vapour, which escapes from the end opening, rises to then be drawn away along suction pipes 20. The suction pipe 20 is connected to the top 19*a* of the shroud 19 and open into the space within the shroud that is the area defined by the top 19*a* and end plates 19*b*. The hot air/water vapour mix escapes when the curtain 21 on the end opening is pushed out of the way by the passage there through of the product.

The rate of water vapour loss out through the curtains is very much less than water vapour loss up the flue because of the lower water vapour pressure at the lower level of the curtains and also because the water vapour must escape horizontally not vertically.

The action by which water vapour escapes from the opened end openings has been observed to be as follows. The escaping water vapour/air mix flows out horizontally while at the same time commencing to rise. An upwardly curved continuous gas flow forms. Water vapour and air are both transparent and invisible but the flow can be observed due to water droplets forming within the flow as it combines with the lower temperature outside air.

The horizontal distance travelled by the hot air and hot water vapour mix exiting a shrink tunnel has been measured at 300 to 330 mm. It will vary with different sized tunnels with different height end openings.

The end duct allows the hot water vapour/hot air mix exiting the tunnel to rise naturally clear of the end opening and to condense in the outside air. The system avoids the condition which occurs with the standard flue of a continuous suction applied to the inside of the tunnel.

There is free access to outside air into the vapour collection ducts 17 and 18. The optimum suction point has been found to be at the highest point in the shroud 19 at the height of the top of the tunnel and hard against the outside end face 11*a* of the tunnel housing 11. It is high enough above the end opening to ensure it does not increase water vapour outflow from the tunnel. The ducts 17/18 thus enable outside cold air and the rising waste hot water vapour to mix. The size of the duct is minimised, as is the volume of air removed from the packing room.

The optimum end duct design can have side draft protection panels 19*b* shaped in a curve (as shown) to follow the natural 300 mm radius outline which has been observed at the outer edge of the stream of hot water vapour as it emerges from the curtains and rises.

Preferably the pipe 20 is also positioned substantially in the middle of the width of the shroud 19.

The air suction pipes 20 will typically be made from a flexible plastic hose. This can be of a diameter of about 50 to 60 mm.

Suction means is/are connected to the ends of the pipes 20. The suction means can be in the form of a mechanism similar to a wet and dry vacuum cleaner. In this way water droplets from the vapour can be collected in the vacuum cleaner reservoir and simply drained to waste, back into the reservoir R or into the supply of water to the reservoir.

With an existing shrink tunnel installation fitted with a fan assisted flue the pipes 20 can be vented to that existing flue. In any event venting will preferably be clear of any air conditioned area.

If the flow of hot water vapour out through the curtains is very high, under extreme load conditions, the ducts can become filled with mixed hot water vapour and air at or above atmospheric pressure which prevents the required inflow of outer cool air into the ducts. Condensation in the ducts will therefore become reduced. For this reason it would be advantageous for the ducts to be made from transparent heat resistant plastic (rather than metal e g stainless steel) so that mist accumulating in the ducts is visible and corrective action can be taken. As an alternative a clear window in the side of a stainless steel duct may be more cost effective.

Additional cooling in the form of a heat exchanger in the duct or an internal water spray may be required. The "make up" water flowing to the tunnel water reservoir R can be used for gas cooling either in a heat exchange panel in the ducts or as a spray immediately inside the tunnel end openings 12/13. It is convenient that the volume of condensate will roughly match the required volume of make up water.

Under these extreme conditions a higher rate of suction from the ducts 17/18 will assist in ensuring the inflow of sufficient cool air to condense all water vapour in the ducts. In the event that conditions are so extreme that this cannot be conveniently achieved it will be necessary to direct the gas flow from the ducts to a conventional vertical flue. Tests show that even under these extreme conditions heat energy savings can still exceed 50% compared with the same tunnel fitted with a conventional flue.

A standard shrink tunnel fitted with a fan assisted flue, in effect, uses internal vacuum to minimise losses out the end openings. As a consequence, the height of the curtain 21 is usually far higher than the highest product that will pass through the end opening 12/13. With the present invention heat loss through the curtains 21 will be further minimised by placing the top edge of the end openings as low as possible so that the pressure of the hot air mix inside the tunnel is at a minimum where the curtains 21 open. The minimum height of the end opening will thus be governed by the height of the highest product required to pass through.

Hence in the present invention the height of the end opening will ideally be kept to just a little higher (say 5 mm higher) than the required clearance for product passing there through.

This allowance in height will enable the curtains 21 to bend out of the way at the top without obstructing the product. Similarly the outermost horizontal edge of the vapour collection shrouds 19 should be at the lowest height consistent with providing clearance for the highest products. This minimises the distance they must extend away from the tunnel in order to capture all escaping vapour.

However, the lowest height of the duct will also be limited by the need for adequate access for outside air to enter the duct so that a partial vacuum is not created which could draw hot water vapour out through the curtain.

The curtains 21 will, when in the closed position, need to provide as good a seal as possible with the edges of the openings 12/13.

The major saving from this invention has been found to be the reduction in heat loss by collecting waste hot humid air only after it has escaped from the end openings. This can be in the order of only 5 kilowatt in an operating tunnel, compared to as high as 50 kilowatt or more heat loss up the flue in a conventional tunnel.

Figure 2:
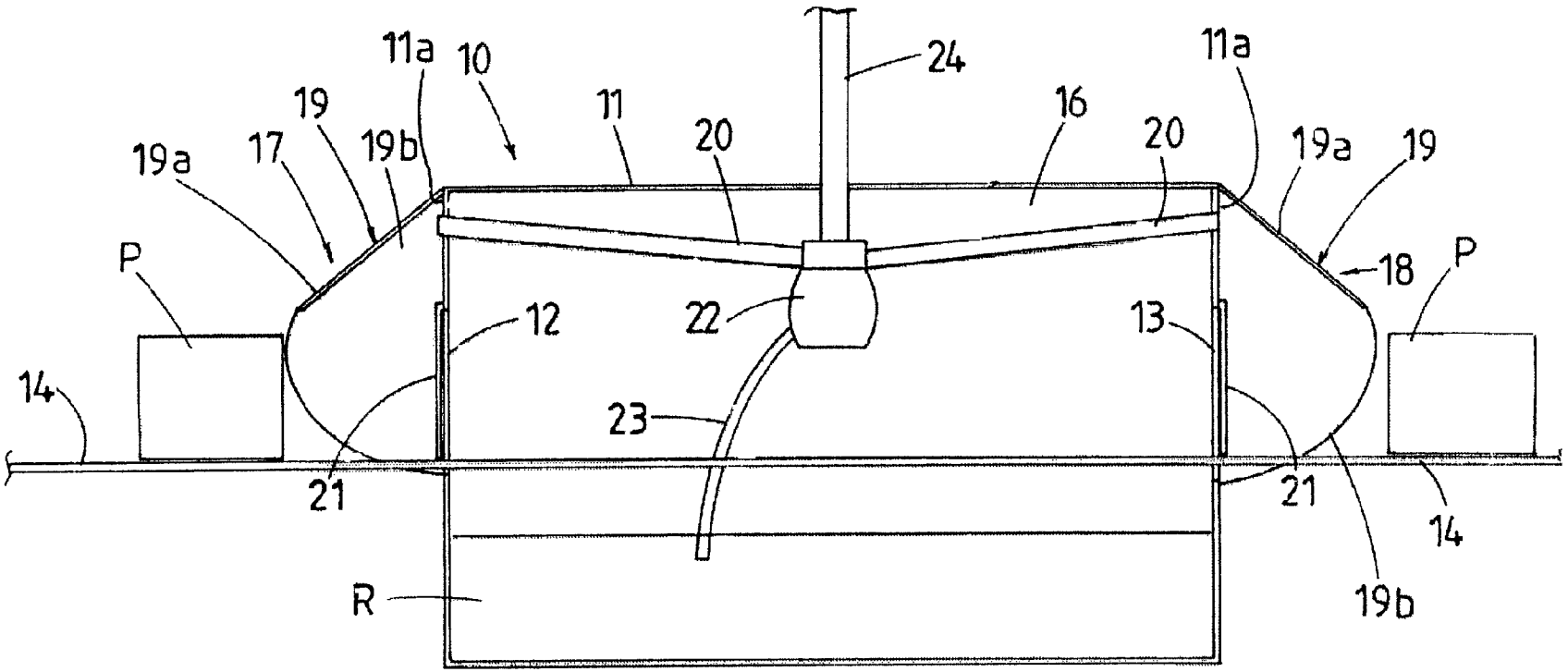
FIG. 2 is schematic elevation view of a second embodiment.

In FIG. 2 there is shown a preferred arrangement in which the suction means is a suction unit 22 located within the housing 11. It can be situated in or adjacent the tunnel control unit at the rear of the tunnel. The wet air suction pipes 20 thus extend within the housing 11. A dry air flue 24 extends upwardly from the suction unit 22 and out of housing 11. A drain pipe/hose 23 extends from suction mechanism 22 so that recovered water flows back to the reservoir R.

Only warm air will be emitted from the tunnel. This warm air will be effectively dry. The waste water vapour it contained will have condensed at time of capture when diluted with cool atmospheric air. The water droplets so formed will have been removed in the cyclone action of the wet and dry vacuum cleaner mechanism.

It will be appreciated by those skilled in the art that the present invention can be applied to an existing shrink tunnel by modification of the tunnel construction. In one embodiment the existing vertical flue could be blanked off and externally of the tunnel the warm air output from suction pipes 20 could be exhausted through the existing flue.

The invention, however, opens the way for a new design of shrink tunnel which has no direct water application to the product. This will be of benefit to end users who object to water in a packing area. This can be achieved by the present invention due to control of water vapour provided by the end opening ducting system.

In a conventional shrink tunnel a rapid increase in water vapour occurs when the spray water curtain is turned on. As a result, 100% relative humidity is achieved quickly due to the great increase in evaporating water surface area provided by the water droplets. This water spray evaporation phenomenon could be used to maintain 100% relative humidity in the shrink tunnel. The water spray could be reduced in size and located to one side so that passing products do not encounter liquid water.

Such a "water vapour tunnel" would be expected to require high velocity hot gas using (existing hot air shrink) tunnel fan technology.

It is likely with such a water vapour tunnel that only very small amounts of liquid water would form on the product during the water vapour shrink process due to the extraordinarily high latent heat of evaporation contained in a small volume of water. The amount of energy required to shrink thin shrink films will also be very low.

It is thus likely that the emerging shrunk products could be essentially dry with the water condensation not in the form of drops but evenly spread as a thin film easily removed with a dry air blast.

Water vapour has a much better heat transfer rate than air. Energy consumption of a hot water vapour tunnel would be expected to be very much lower than existing hot air tunnels requiring upwards of 30 kilowatt. It would probably be below 10 kilowatt and similar to the figures achieved with the flue less water spray tunnel.

A purpose built tunnel incorporating the present invention may require something in the order of 10 kilowatt in heating elements and only about a 30 liter water tank which should be enough for the spray volume plus immersion of the heating element(s). Such a tunnel would be light enough to be mounted on wheels. The tunnel would thus be readily moveable especially if the warm air removal duct/hose was connectable to the tunnel in a quick release type fitting.

Thus a compact, energy efficient and portable/moveable shrink tunnel can be achieved by use of the present invention.

According to the present invention the rate of evaporation which can occur in a conventional shrink tunnel can be reduced significantly by the containment of water vapour in the headspace in the tunnel so that the level of water vapour rises to equilibrium water vapour pressure. This is achieved because the rate of water evaporation gets lower as the relative humidity of the air gets higher. In this way evaporation will actually stop when product flow through the tunnel ceases and assuming the curtains over the end openings form a good seal. The ducts over the end openings enable any wet vapour which escapes through the end openings (eg during passage of product there through) to be contained.

Energy wastage can thus be reduced as the wastage is largely confined to the wet vapour that escapes through the end openings. The flow that occurs out the end openings is significantly less than the flow which occurs straight up a flue from the housing.

The two inherent problems with existing hot water (both spray and immersion) shrink tunnels namely high energy consumption and emission through the openings in the heat chamber are overcome by the present invention.

The shrink tunnel and method of operating same has been shown in initial trialling to achieve energy savings of between 83% and 93% compared to an existing shrink tunnel.

The invention is open to modification within the scope of the invention as will be apparent to the skilled person.

Figure 3:
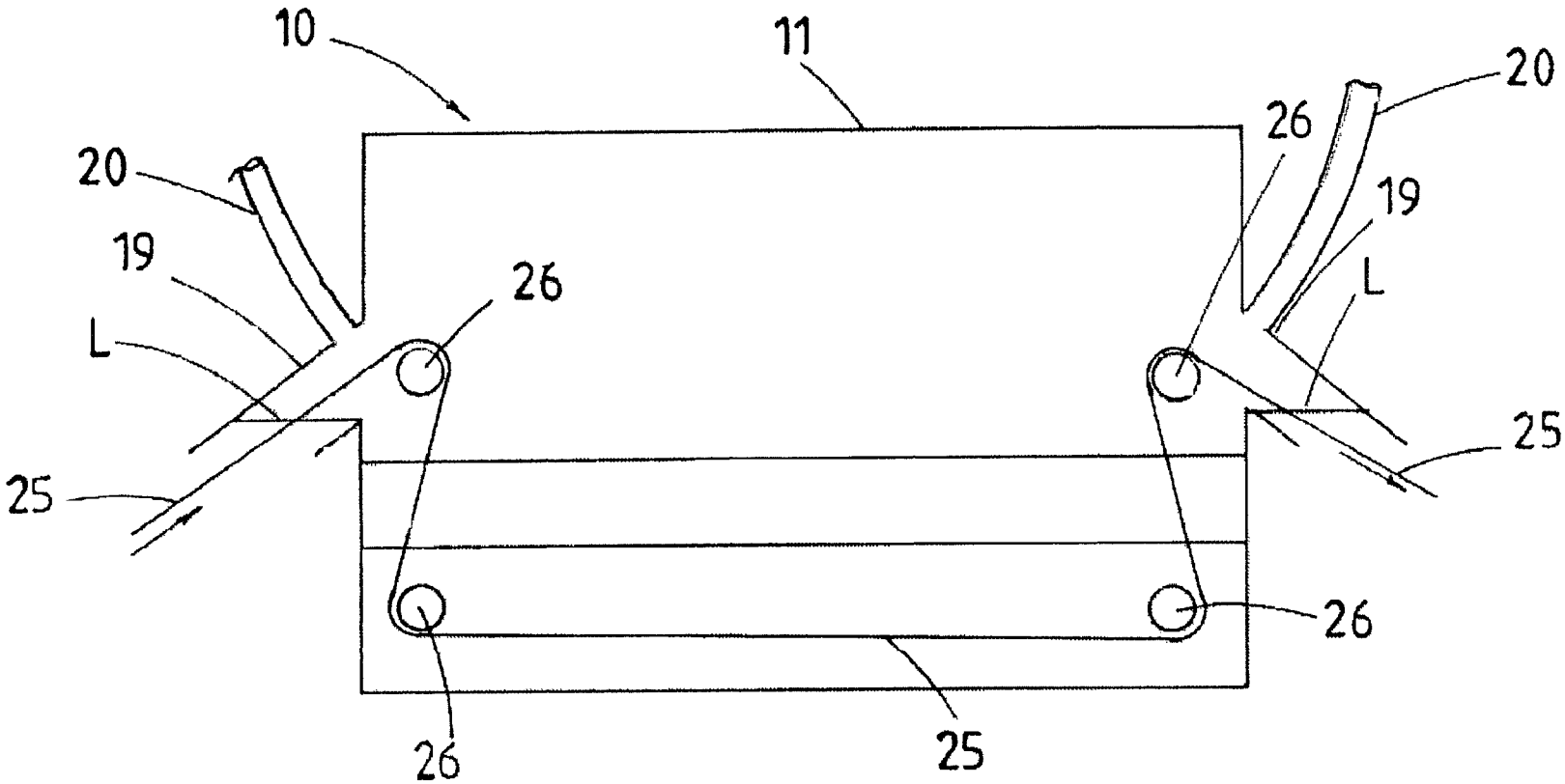
FIG. 3 is a schematic elevation or a third embodiment.

A further form of the invention which I have devised is shown in FIG. 3. The shrink tunnel construction in this form involves inclining the shroud 19 down so that it extends lower down at each end of the tunnel 10. The shroud 19 will thus extend down to cover the inlet/outlet opening 12/13 as viewed end on to the tunnel. This results in the opening 12/13 being below the natural vapour line L. When water vapour is prevented from rising in this way, while outside the tunnel (i e away from the liquid water surface), it forms a natural water vapour line at the level of the lower edge of the opening. Being lighter than air the water vapour/hot air mix is unable to fall below the level at which it emerges from the tunnel.

Such an arrangement is not particularly practical for individual packages as it would require clumsy and space consuming mechanisms to lift the packages in and out of the tunnel. Also the angle of the slope of top 19*a* is dependant on the product height and is very steep thus will be impractical for a typical product height of say 160 mm.

However, in some cases where the product to be heated is of a continuous long thin form (e g ribbon form) the product 25 could be pulled or driven through the tunnel on rollers 26, as shown, or other suitable mechanism and the slope angle will be very flat. To facilitate feeding through of a new length of ribbon the shrouds 19 could be hinge mounted to the tunnel housing.

To maximise the advantages of the present invention it is preferable to minimise hot water vapour and hot air movement in and out through the end openings of the tunnel. This is achieved by maintaining an air tight seal down to the lowest level possible. To this end it is desirable to use a curtain construction at each end opening which optimises the sealing effect as is discussed above. For example the end curtain could be made from thicker material than is normally used for end curtaining.

However, in a yet further embodiment of the invention sealing flaps fitted with close fitting fixed side plates can be employed so that a longitudinal vapour exit path does not form as the flaps and curtains are forced open by passing products.

When no product is passing through the end opening the curtain (being a plurality of hanging strips of flexible material) closes the opening and substantially seals the opening assuming the curtain is in good condition with the strips in contact with one another and the outermost strips in contact with the side edges of the opening. However, within the heat chamber the internal pressure increases up from the level of the bottom of the end opening. As a result there is at the bottom of the curtain a continual flow of air into the tunnel which replaces gas flow out higher up the curtain. This gas flow (of steam and air) occurs through any hole or slit in the curtain due to the internal pressure in the heat chamber being above atmospheric relative to height above the bottom of the curtain.

When the curtain is pushed open, due to the passage there through of product, a longitudinal gap occurs between an opened strip and it's adjacent an unopened strip. This longitudinal gap permits hot water vapour and hot air to escape. While the ducts of the present invention enable this to be captured it is desirable to minimise the amount which escapes especially during high product movement through the end openings.

Figure 4:
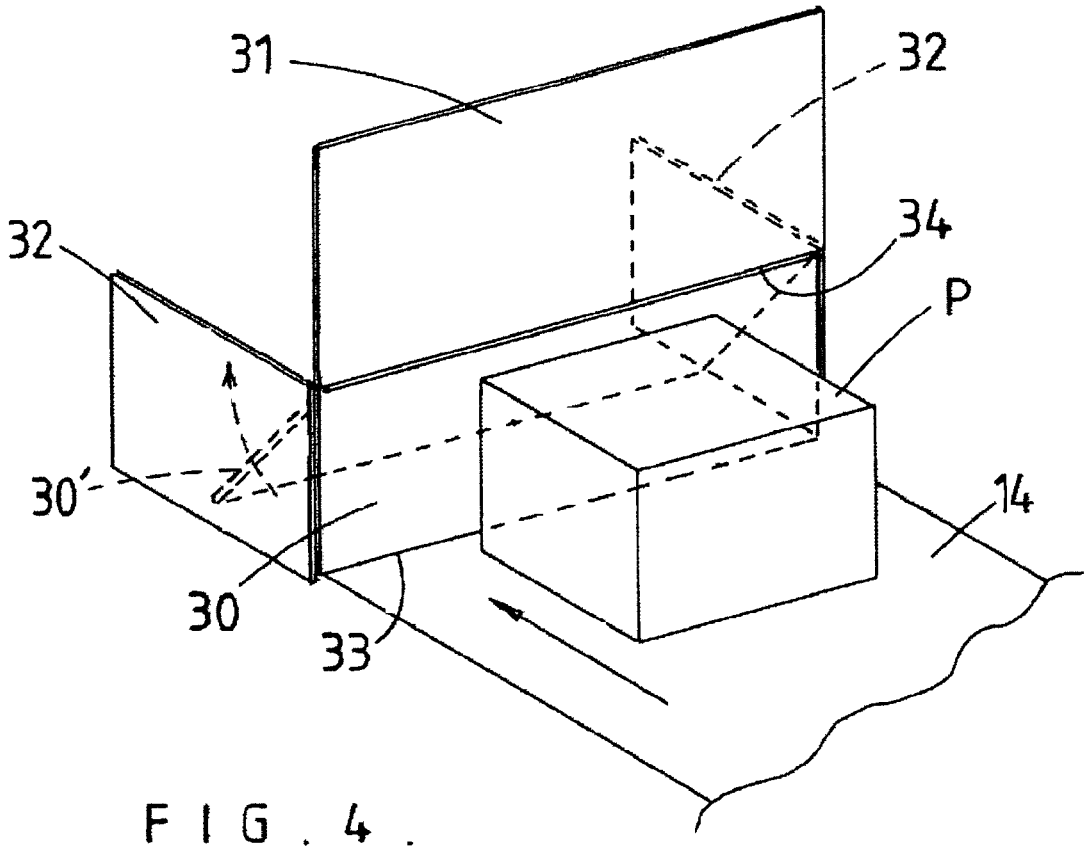
FIG. 4 is an isometric schematic view of a flap arrangement for use in yet a further embodiment of the invention.

Accordingly in the further form of the invention as shown in FIG. 4 a hinged flap arrangement is positioned inside the heat chamber adjacent each curtain. FIG. 4 shows the flap arrangement adjacent the inlet end opening 12. As illustrated a flap 30 is pivotally coupled to a lowermost part of a partition 31 which extends from side to side and to the top of the heat chamber. In the rest position of the flap 30 it hangs downwardly from the partition as shown.

The end edges of the flap 30 slidingly engage with fixed end plates 32 which extend normally to the partition 31. It will be appreciated that the lowermost edge 33 of the flap 30 is located just clear of the surface of the conveyor 14.

Thus as a product P is moved along by the conveyor 14 it moves through the curtain 21 and then comes into contact with the flap 30. The contact between product P and flap 30 causes the flap to pivot about its pivot axis to an open position. This open position is shown by the dotted flap outline 30'. As it pivots the edge of the flap passes over the surface of the fixed end plate 32 so that no longitudinal gap occurs.

Once the product P is clear of the flap 30 the flap 30 will revert to its hanging or rest position at which point the product P continues through the heat chamber.

At the outlet end of the heat chamber the flap arrangement is such that the product P will contact the flap 30 to cause it to open. Once the product has passed the flap the flap will close where upon the product will then move through the outlet curtain 21.

The lowermost edge 34 of the partition is at a height which provides just sufficient clearance for the product to pass there through. In this way the lowest height level to maximise sealing is achieved. In one form of the invention the partition can be of a construction whereby the lowermost edge 34 can be height adjustable so as to provide for differing height products.

In a preferred form edge seals can be mounted to the side plates for the flap 30 to rest against when the flap is in the rest position.

The invention claimed is:

1. A hot water shrink tunnel comprising:

a heat chamber that has no flue or vent into the heat chamber, the heat chamber having an inlet opening and spaced therefrom an outlet opening, each of the inlet and outlet openings being closed by an end closing device;

means for conveying product through the heat chamber from the inlet opening to the outlet opening; and a duct mounted adjacent each of the inlet and outlet openings, the duct comprising a shroud of a size and design to capture hot water vapor that issues from the heat chamber when product passes through the end closing device.

2. The shrink tunnel as claimed in claim 1, wherein the end closing device comprises a curtain.

3. The shrink tunnel as claimed in claim 2, wherein the end closing device further comprises a flap adjacent to the curtain, the flap being moveable between closed and open positions whereby when the flap is moved to the open position product can pass through the end closing device.

4. The shrink tunnel as claimed in claim 3, wherein a height of the flap is greater than a height of product to pass there through.

5. The shrink tunnel as claimed in claim 3, wherein the flap extends between fixed end plates.

6. The shrink tunnel as claimed in claim 5, wherein the flap of the end closing device at the inlet opening is located after the curtain relative to the direction of movement of a product through the heat chamber and the flap at the outlet opening precedes the curtain with respect to the direction of movement of the product.

7. The shrink tunnel as claimed in claim 1, wherein the shroud comprises a top part which slopes downwardly away from a wall of the tunnel housing to which the shroud is coupled.

8. The shrink tunnel as claimed in claim 7, wherein the sloping part is located between a pair of side plates.

9. The shrink tunnel as claimed in claim 8, wherein a lowest level of the shroud is substantially the same as a top of a height of the inlet and outlet openings.

10. The shrink tunnel as claimed in claim 9, wherein the lowest level of the shroud is such as to provide a clearance sufficient for product to pass beneath the shroud.

11. The shrink tunnel as claimed in claim 1, wherein the shroud is longer than the maximum outward horizontal distance travelled by an upward hot wet gas flow from the inlet and outlet openings so as to capture substantially the entire flow.

12. The shrink tunnel as claimed in claim 1, further comprising means for separating and recovering water content of the captured hot water vapor.

13. The shrink tunnel as claimed in claim 1, wherein the end closing device includes a pivotally mounted flap with end edges of the flap slidingly engaged with fixed end plates.

14. The shrink tunnel as claimed in claim 13, wherein in a closed position the flap hangs downwardly from its pivot mounting and a lowermost edge of the flap is located just clear of an upper surface of the means for conveying.

15. The shrink tunnel as claimed in claim 14, wherein the flap is movable about its pivot axis to an open position and the end edges pass over the surface of the fixed end plates during movement of the flap between the open and closed positions.

16. The shrink tunnel as claimed in claim 15, wherein the flap is pivotally coupled by the pivot mounting to a lowermost edge of a partition that extends from side to side and to a top of the heat chamber.

17. The shrink tunnel as claimed in claim 16, further comprising edge seals mounted to the fixed side plates and positioned whereby the flap rests against the seals when the flap is in the closed position.

18. A method of operating a hot water shrink tunnel the method comprising the steps of:

maintaining a non flued and non vented head space within a heat chamber of the tunnel; and externally of the heat chamber capturing and drawing away hot water vapor as it leaves the heat chamber through an opening into or from the heat chamber when product passes through sealing means associated with the respective opening.

19. The method according to claim 18, further comprising the step of separating water content from the captured hot water vapor and returning this to the heat chamber or to a hot water supply to the heat chamber.

20. The method according to claim 19, further comprising the step of cooling the captured hot water vapor.

* * * * *